US006155496A

United States Patent [19]

Brunet et al.

[11] Patent Number: 6,155,496

[45] Date of Patent: Dec. 5, 2000

[54] TWO-PHASE SPRAY DEVICE FOR A FLUID OR PASTY MATERIAL

[75] Inventors: Michel Brunet, Plufur; Olivier de Pous, Paris, both of France

[73] Assignee: Valois S.A., Le Neubourg, France

[21] Appl. No.: 09/180,036

[22] PCT Filed: May 6, 1997

[86] PCT No.: PCT/FR97/00808

§ 371 Date: Mar. 11, 1999

§ 102(e) Date: Mar. 11, 1999

[87] PCT Pub. No.: WO97/41965

PCT Pub. Date: Nov. 13, 1997

[30] Foreign Application Priority Data

May 7, 1996 [FR] France ..... 96 05682

[51] Int. Cl.[7] ..... B67D 5/52; B05B 9/043

[52] U.S. Cl. ..... 239/333; 239/372; 239/373; 222/137; 222/321.9

[58] Field of Search ..... 239/333, 337, 239/372, 373; 222/129, 135, 137, 145.1, 145.5, 145.6, 321.1, 321.7, 321.9

[56] References Cited

U.S. PATENT DOCUMENTS

| | | | |
|---|---|---|---|
| 3,239,151 | 3/1966 | Jokelson . | |
| 4,214,677 | 7/1980 | Bauer et al. . | |
| 4,249,676 | 2/1981 | Beery | 222/321.9 |
| 5,289,952 | 3/1994 | Gueret . | |
| 5,326,000 | 7/1994 | Fuchs . | |
| 5,443,569 | 8/1995 | Uehira et al. | 222/321.9 X |
| 5,752,627 | 5/1998 | Vandromme et al. | 222/137 |

FOREIGN PATENT DOCUMENTS

| | | |
|---|---|---|
| 0 613 727 | 9/1994 | European Pat. Off. . |
| 2 397 341 | 2/1979 | France . |
| 1475 153 | 5/1969 | Germany . |
| 4331 279 | 3/1995 | Germany . |
| 0404 569 | 12/1965 | Switzerland . |

OTHER PUBLICATIONS

Title page of WO 95/07763 dated Mar. 1995.
Title page of WO 89/00086 dated Jan. 1989.

*Primary Examiner*—Andres Kashnikow
*Assistant Examiner*—Robin O. Evans
*Attorney, Agent, or Firm*—Rockey, Milnamow & Katz, Ltd.

[57] ABSTRACT

A device mountable on a material container for dispensing fluid or pasty material therefrom is disclosed. The device comprises a first pump (10) for selectively dispensing the material from the container through an outlet (31), said first pump being mountable on the container by means of an attachment member (11), and a manual actuation member (30) movable between an inoperative position and an actuated position. The device further comprises a second pump (20) for dispensing compressed air at the same time as the material is dispensed. The second pump comprises two elements (21, 22), i.e. a plunger (21) and a pump cylinder (22) slidably housing the plunger (21), and is designed to feed a flow of compressed air to the outlet (31) in order to spray the material. One of said two elements (21, 22) of said second pump (20) is secured to said attachment member (11) of the first pump (10), whereas the other of said two elements (21, 22) is secured to the actuation member (30).

11 Claims, 4 Drawing Sheets

TWO-PHASE SPRAY DEVICE FOR A FLUID OR PASTY MATERIAL

CROSS-REFERENCE TO RELATED APPLICATIONS

This application is an application filed under 35 U.S.C. Sec. 371 as a national stage of international application PCT/FR97/00808, which was filed May 6, 1997.

STATEMENT REGARDING FEDERALLY SPONSORED RESEARCH OR DEVELOPMENT

Not Applicable.

BACKGROUND OF THE INVENTION

1. Field of the Invention

The present invention concerns an improved spray device for a fluid or a pasty product, and more particularly a two-phase spray device.

2. Description of the Related Art

Different types of devices in the state of the art have been proposed to obtain a product spray as fine as possible, even with manual actuation. However, it has proven to be that these sprays do not reach the same quality as those obtained for example with devices containing aerosols.

To resolve this problem and to obtain the finest possible spray, two-phase spray devices were proposed. Such a device was described in the document EP-0,306,066. This device includes a product container on which is mounted a first pump for selectively dispensing the product contained in the container, said pump being actuated by a plunger including an outlet, a second pump for feeding said outlet a flow of compressed air simultaneously with dissemination of the product, to thus improve the quality of the spray, said second pump including a plunger sliding in said plunger. This type of device allows, during the actuation of the plunger the dissemination of the entire product contained in the container and the flow of compressed air from the second pump. Thus, the product is advantageously sprayed by means of this flow of compressed air.

The device of document EP-0,306,066 however, has some drawbacks. In particular, the device is complicated in construction and therefore relatively expensive to manufacture and to mount. Furthermore, the plunger of the pump generating the flow of compressed air is mounted on the pump body, which consequently means that this pump body must be adapted to receive such a plunger element. It is therefore not possible to adapt this two-phase pump device to a conventional pump. On the other hand, because the plunger element of the pump with compressed air is mounted on the pump body, the procedure of mounting such a two-phase pump is made more complicated. Furthermore, to be able to receive the plunger element of the pump with compressed air and to allow a sufficient movement of the plunger for actuating the device, the height of the two-phase pump of document EP-0,306,066 is relatively great, which increases as well the total volume of the device in its entirety. On the other hand, the device disclosed does not allow the achievement of a two-phase pump including a spray orifice that remains fixed during the actuation of the device.

BRIEF SUMMARY OF THE INVENTION

A goal of the present invention is to provide a spray device of fluid and pasty product but in particular a two-phase spray device not reproducing the above mentioned drawbacks.

In particular, a goal of the present invention is to provide such a two-phase spray device that is simple and less costly to mount and to manufacture. Furthermore, a goal of the present invention is to provide such a two-phase spray device in which a conventional pump can be used and which can be assembled on the same assembly line while modifying only a minimum of components of the device in its entirety. A goal of the present invention is also to provide such a two-phase spray device that has minimal pump height and therefore minimal overall volume. A goal of the present invention is also to provide such a two-phase spray device that includes a spray that remains fixed during the actuation of the device.

Therefore a goal of the present invention is an adaptable spray device for fluid and pasty products on a product container, a first pump for selectively disseminating the product contained in said container through an outlet, said first pump mountable on the container by means of an attachment member, and a manual actuating member movable between a position of rest and a position of actuation, said device including in addition a second pump for disseminating compressed air simultaneously with the dissemination of the product, said second pump including two elements which are a plunger and a pump cylinder in which said plunger slides, said second pump being adapted to feed towards the outlet a flow of compressed air for spraying the product, characterized in that one of said two elements of said second pump is secured to said attachment organ of said first pump and the other of said two elements is secured to the actuating member. Therefore, the spray device according to the invention can be mounted at low cost because the first pump, the container and the attachment member of the first pump on the container can be of a conventional type and can therefore be assembled in the same assembly line as spray devices that are not two-phase.

The manufacturing and assembling of the device of the invention are therefore simpler, faster and less costly.

Preferably, one of said two elements of the second pump is an integral part of a collar secured to said attachment member.

According to an advantageous first method of execution of the invention, said plunger of the second pump is secured to the collar and slides in the pump cylinder formed in the actuating member, said pump cylinder being connected to said outlet by an air duct. Thus, by comparison with a pump of the conventional type, the two-phase spray device according to the invention only includes two different or modified elements, the collar supporting the plunger and the air duct arranged in the actuating member. To obtain the device of the invention, it is sufficient to arrange such a duct in the conventional actuating member used with conventional pumps and to provide the collar supporting the plunger around the attachment member of the pump.

According to an advantageous second method of execution of the invention, said plunger of the second pump is secured to the actuating member and slides in the pump cylinder which is secured to said collar, said pump cylinder being connected to said outlet by an air duct.

Advantageously, said air duct includes a valve adapted to be opened when the air included in the pump cylinder is compressed to a predetermined level.

Preferably, said second pump includes means for air renewal.

Advantageously, said means for air renewal includes a valve adapted to be opened when an upward pressure is created in the pump cylinder.

According to an advantageous method of execution of the invention, said plunger of the second pump is formed by a soft ring secured to a collar secured to the attachment member of the first pump, said ring sliding in a leakproof manner in a pump cylinder formed in the actuating member when the latter is displaced towards its actuating position to compress the air, and said ring being adapted to be deformed to allow a renewal of air in the pump cylinder when the actuating member is brought back towards its resting position.

Advantageously, the spray device includes in addition an expulsion chamber connected to the first pump, to the second pump and to the outlet, the product and the compressed air being mixed in said expulsion chamber before being sprayed through the outlet.

Advantageously, the volume of the pump cylinder is approximately zero when the actuating member is in the actuating position.

Preferably, said collar includes ratcheting means for being ratcheted to said attachment member of the first pump.

Preferably, said outlet is formed in said collar, such that it remains fixed during the actuating of the device.

BRIEF DESCRIPTION OF THE SEVERED VIEWS OF THE DRAWINGS

Other characteristics and advantages of the present invention will appear during the following detailed description, given by way of nonlimiting examples, with reference to the attached drawings in which:

FIG. 1 is a diagrammatic view in section of a device according to a first method of execution of the invention with the actuating member in resting position, FIG. 2 is a similar view to that in FIG. 1, with the actuating member in the actuating position, FIG. 3 is a more detailed diagrammatic view of a part of the actuating member according to a variation of execution of the invention, FIG. 4 is a similar view to that of FIG. 3 and represents another variation of execution of the invention, FIGS. 5 and 6 represent two examples of execution of an insert simultaneously forming the air duct and valve for the compressed air pump, FIG. 7 represents a diagrammatic view in section of another method of execution of the invention, FIG. 8 represents a diagrammatic view in section of a device according to a second method of execution of the invention, with the actuating member in resting position, and FIG. 9 is a view similar to that of FIG. 8 with the actuating member in actuating position.

DETAILED DESCRIPTION OF THE INVENTION

Figure 1:
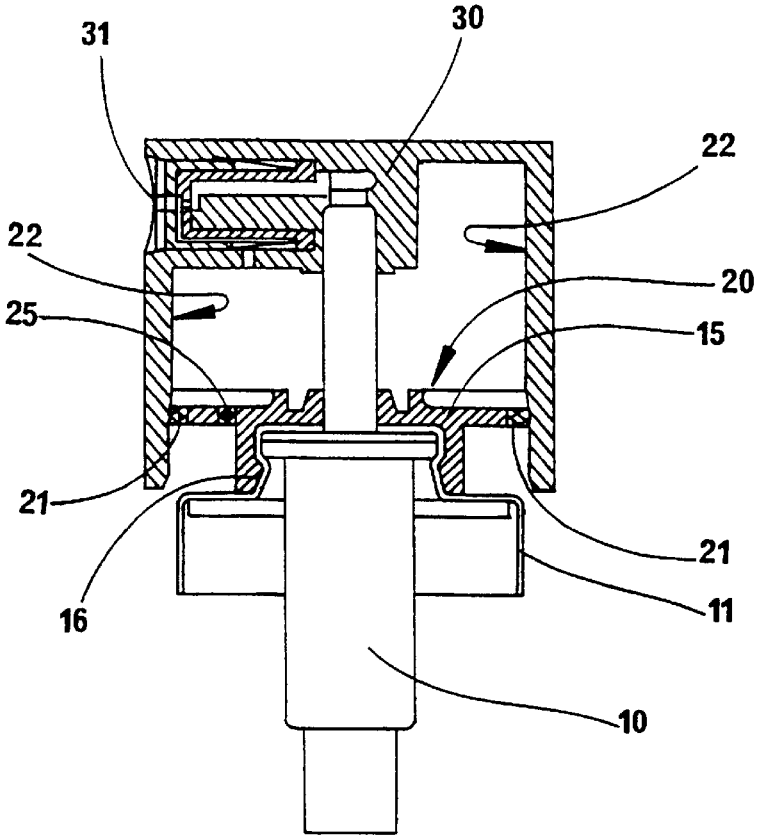

With reference to the figures, the spray device of the invention includes a first pump 10 adapted to disseminate selectively the fluid and pasty product contained in the container (not shown). This pump 10 can be of any type, and is advantageously of conventional type, that is of the type usually used in the conventional devices for disseminating fluid products, well known in the state of the art. Said first pump 10 is mounted on the container by means of an attachment member 11 which can be of any type, such as a collar with a ratchet mechanism or a crimped collar. Conventionally, the device includes in addition an actuating member 30 adapted to actuate said first pump 10 to disseminate selectively the product of the container. The actuating member 30, which is manually actuated, can for example be a plunger. The spray device includes an outlet 31 through which the product is expelled. Advantageously, said spray device includes in addition, near the outlet 31, a nozzle 38 to ensure good spraying of the product.

The two-phase spray device according to the invention includes in addition a second pump 20 adapted to disseminate compressed air simultaneously with dissemination of the product. This second pump 20 includes a plunger 21 that cooperates with a pump cylinder 22 to feed a flow of compressed air towards the outlet 31.

According to an advantageous first method of execution represented in FIGS. 1 to 7, plunger 21 slides in pump cylinder 22 formed on the interior of actuating member 30. In the resting position of the actuating member 30, represented in FIG. 1, the pump cylinder 22 is filled with air and when the actuating member 30 is actuated to disseminate the product contained in the container, cylinder 21 slides in the pump cylinder 22, in this way compressing the air contained in pump cylinder 22, such that the actuating of the actuating member 30 causes a flow of compressed air in the direction of the outlet 31. In this way, the pump cylinder 22 is advantageously connected to said outlet 31 by means of an air duct 32, as visible in FIGS. 3 to 6. Preferably, said air duct 32 includes a valve 33 closing said air duct 32 and which is adapted to be opened when a predetermined level of pressure prevails in the interior of pump cylinder 22. Thus, the time from which the flow of compressed air is sent towards the outlet 31 as well as the degree of compression of the air can be determined. When the actuating member 30 is in its actuating position 30, represented in FIG. 2, a dose of product has been expelled from the container by means of first pump 10 and the air contained in the pump cylinder 22 has been expelled in the form of a flow of compressed air 32 towards the outlet 31. To allow the return of the actuating member towards its resting position, second pump 20 includes preferably means of air renewal 25. This means of air renewal 25 can be for example achieved in the form of a valve 25 adapted to be opened when an upward pressure is created in the pump cylinder 22 from the return of the actuating member 30 towards its resting position.

Thus, when the actuating member 30 is displaced from its resting position towards its actuating position, the valve 25 is closed to prevent an escape of air contained in the pump cylinder 22, and valve 33 is opened to allow a dissemination of the flow of compressed air towards the outlet 31. When the actuating member 30 is brought back from its actuating position towards its resting position, valve 33 is closed and valve 25 is opened to allow renewal of air in pump cylinder 22.

According to the invention, plunger 21 of the second pump 20 is secured to the attachment member 11 of the first pump 10. In particular, the invention provides that plunger 21 is independent of the pump body of the first pump 10 such that it is possible to provide a pump 10 of the conventional type which does not require a specific adjustment to allow achieving a two-phase device such as described in the present invention.

Advantageously, said plunger 21 of the second pump 20 is an integral part of a collar 15 secured to the attachment organ 11. This collar 15 advantageously includes means of attachment, such as ratcheting means 16, to be ratcheted to the attachment organ 11 of the first pump 10. Thus, after the positioning of the first pump 10 in the container and the attachment of this first pump 10 on said container by said attachment member 11, it is sufficient to obtain a two-phase spray device according to the invention, to ratchet said collar 15 to the attachment organ 11. The transformation is therefore very simple, can be achieved on the same assembly unit and is therefore much less costly.

Figure 2:
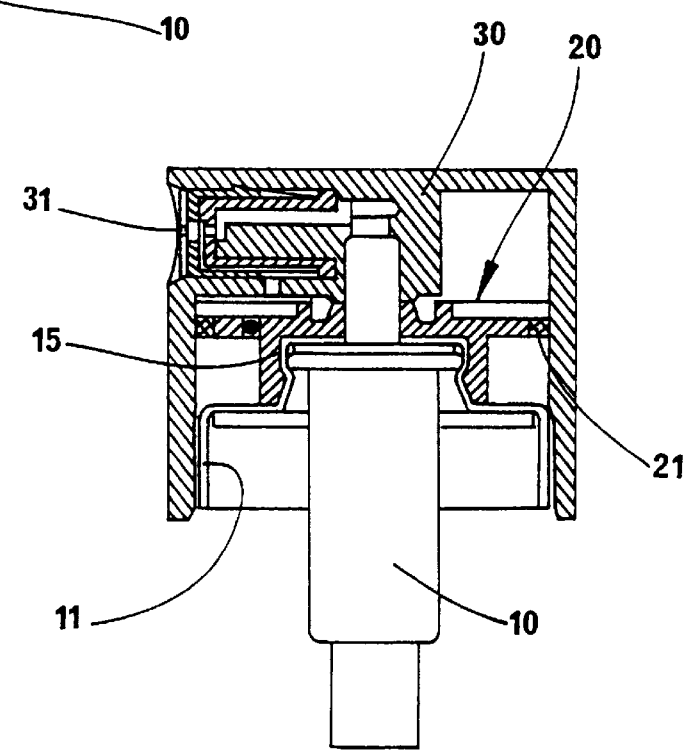
Figure 3:
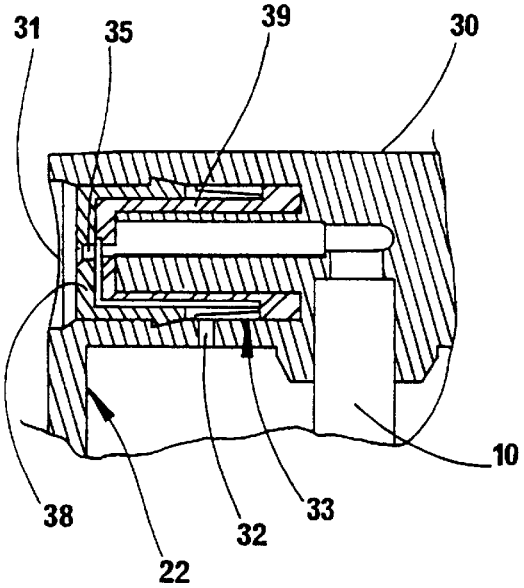
Figure 4:
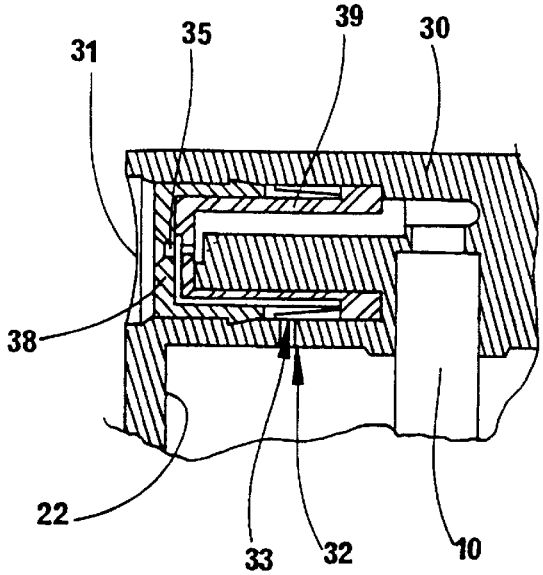

A first variation of execution of the invention is represented in FIGS. 1 and 2. In this first variation, plunger 21 is formed by a lip 21 which slides in a leakproof manner in the pump cylinder 22 between the resting position and actuating position of the actuating member 30, said lip being arranged on the radial extremity of the collar 15. In this case, the collar 15 includes in addition means of air renewal 25, which can for example be achieved in the form of a valve with a ball, or any other valve of known type.

Figure 7:
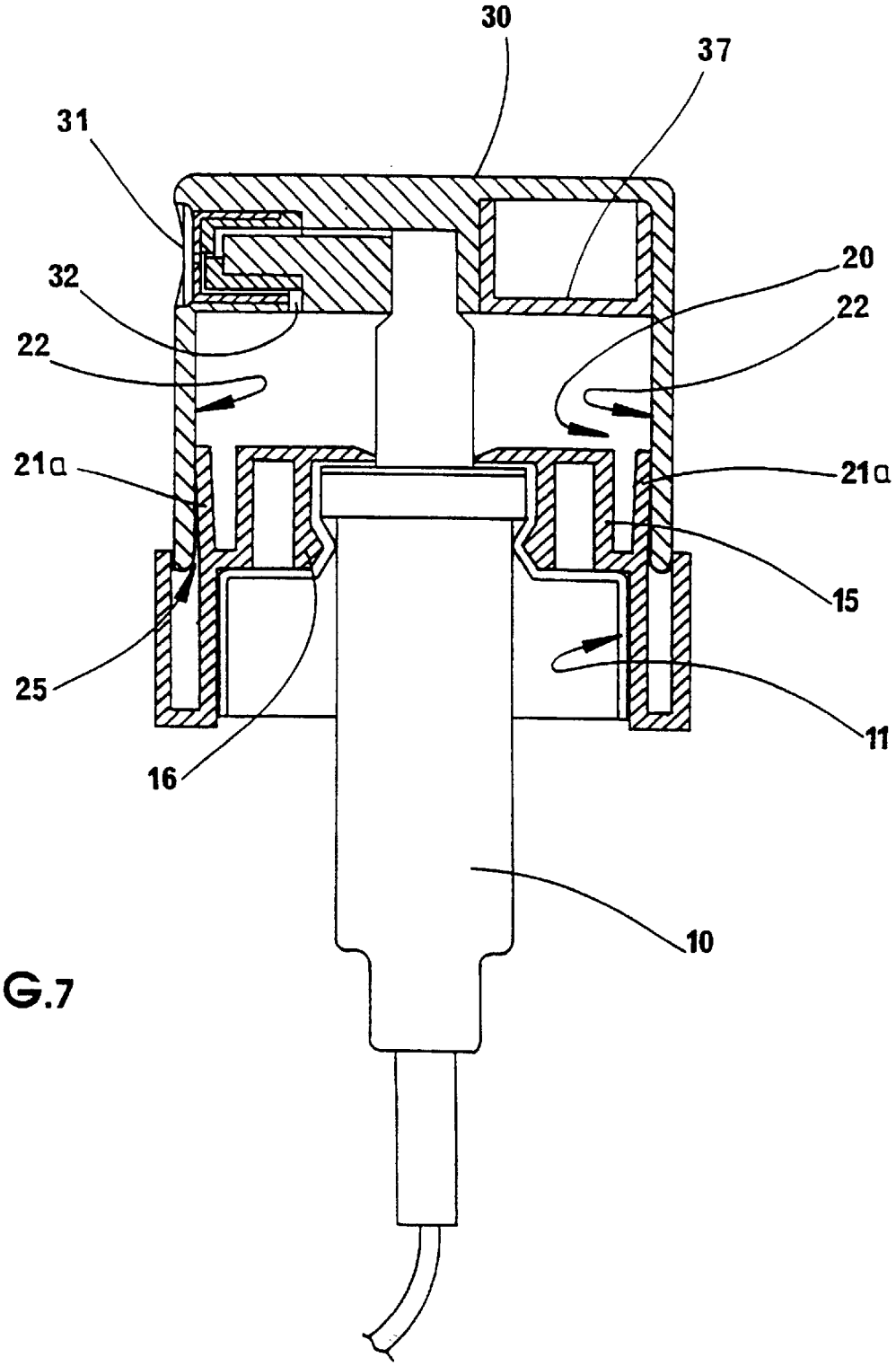

Another variation of execution is represented in FIG. 7. In this variation of execution, the plunger 21 is formed by a soft and deformable ring 21*a* that is secured to collar 15. This ring 21*a* slides in a leakproof manner in the pump cylinder 22 formed in the actuating member 30 when the latter is displaced from its resting position towards its actuating position, and in contrast to plunger 21 of the first method of execution, said ring 21*a* is adapted to be deformed when the actuating member 30 is brought back towards its resting position, to allow a renewal of air 25 in the pump cylinder 22. In this case, the presence of a valve in the collar 15 is not necessary.

FIGS. 3 to 6 represent in a more detailed way the air duct 32 and the valve 33 adapted to the transmission of the flow of compressed air from the pump cylinder 22 towards the outlet 31. Thus, in the example represented in FIGS. 3 and 4, the actuating member 30 includes a nozzle 38 adapted to spray the product expelled by the first pump 10. This nozzle 38 includes preferably an expulsion chamber 35 connected to outlet 31, to the first pump 10 and to the second pump 20 through the air duct 32. To do this, an insert 39 is placed adjacent to said nozzle 38, said insert 39 including means such as a groove 32 to form said air duct which opens into the pump cylinder 22 by an orifice arranged in said actuating member. Thus, the flow of compressed air coming from the second pump 20 and the dose of product coming from the first pump 10 are advantageously mixed in the expulsion chamber 35 of the nozzle 38 and are next sprayed through the outlet 31. In a known manner said nozzle 38 can include any appropriate means for guaranteeing good spraying of the product, in particular, means for achieving swirling of the latter before being expelled through the outlet 31.

Figure 5:
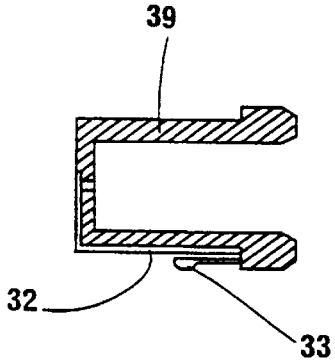
Figure 6:
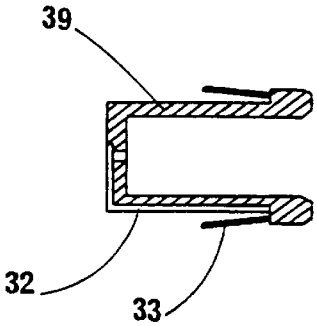

Insert 39 attached in the actuating member 30 adjacent to nozzle 38 advantageously incorporates valve 33. As represented in FIGS. 5 and 6, this valve 33 can be formed by a soft strip applied in the resting state in a position where it seals off the air duct 32, with excess pressure created in the pump cylinder 22 above a predetermined level unblocking said air duct 32 by deforming said strip 33. Therefore, the characteristics of the flow of compressed air can be determined with the choice of the strip 33 (softness, material, etc.).

Possibly, as represented in FIG. 7, the actuating member 30 can in addition include means 37 arranged on the interior of said activating member 30 to configure the pump cylinder such that when the actuating member 30 is in its actuating position, the volume of said pump cylinder 22 is approximately zero. One can, for example provide for filling dead volumes in the interior of the actuating member.

Thus, a two-phase spray device, object of the first method of execution of the present invention described above in reference to FIGS. 1 to 7, can be achieved with a minimum of modification in comparison to a spray device of the conventional type, that does not include the second pump creating the flow of compressed air. In fact, it is sufficient to add the collar 15, supporting plunger 21 and to slightly modify the actuating member 30 while providing said duct 32 and said valve 33 to obtain all the advantages of the two-phase device. Since these modifications are not very significant they can be achieved with very little cost. This is accordingly truer since collar 15 and actuating member 30 can be assembled at the end of mounting, such that the invention does not require a specific assembly line. Furthermore, the fact that the collar bearing the plunger 21 of the second pump 20 is arranged around the attachment member 11 of the first pump 10 on the container, enables the height of the pump not to be increased and therefore the volume of the device in its entirety.

Figure 8:
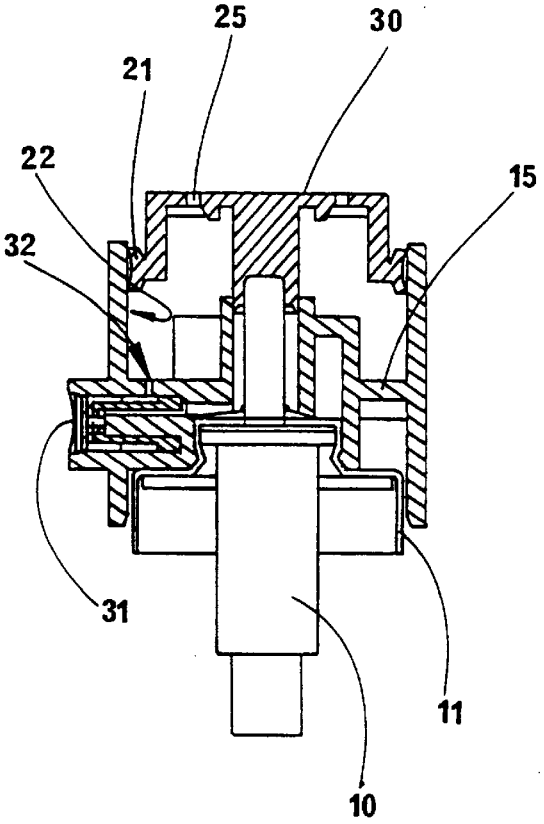
Figure 9:
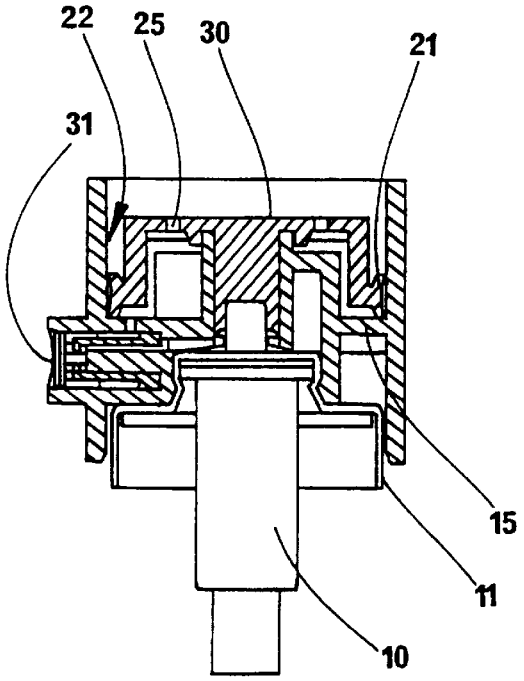

In FIGS. 8 and 9 a second method of execution is described. In this second method of execution the pump cylinder 22 is secured to the collar 15. Preferably, the pump cylinder 22 forms an integral part of said collar 15. This collar 15 also includes the outlet 31 and, if applicable the nozzle 38, insert 39 and the expulsion chamber 35 previously described.

The use of air duct 32, valve 33 and other elements above is exactly similar to that of the first method of execution of the invention described in reference to FIGS. 1 to 7, with the difference that the outlet 31 remains fixed during actuation of the spray device.

In the second method of execution the plunger 21 is secured to the actuating member 30, and slides in the attached pump cylinder 22 when said actuating member is displaced.

Preferably, plunger 21 includes an annular lip that slides in a leakproof manner in the pump cylinder 22, and the actuating member 30 incorporates the means of air renewal 25 of the second pump 20. These means can be similar to those described in reference to FIGS. 1 and 2.

This second method of execution therefore allows a two-phase pump to be achieved according to the invention which incorporates all the above mentioned advantages, which furthermore includes a spray outlet, and therefore spraying of the product which remains fixed during the actuation of the device.

What is claimed is:

1. Adaptable spray device for fluid and pasty products on a product container, a first pump (10) for selectively disseminating the product contained in said container through an outlet (31), said first pump mountable on the container by means of an attachment member (11), and a manual actuating member (30) movable between a resting position and an actuating position, said device including in addition a second pump (20) for disseminating compressed air simultaneously with the dissemination of the product, said second pump (20) including two elements (21,22) which are a plunger (21) and a pump cylinder (22) in which said plunger (21) slides, said second pump (20) being adapted to feed towards the outlet (31) a flow of compressed air for spraying the product, one of said two elements (21,22) of said second pump (20) is secured to said attachment member (11) of said first pump (10) and the other of said two elements (21,22) is secured to the actuating member (30), said plunger (21) of the second pump (20) is formed by an annular ring (21*a*) secured to a collar (15) secured to the attachment member (11) of the first pump (10), said ring (21*a*) sliding in a leakproof manner in the pump cylinder (22) formed in the actuating member (30) when the latter is displaced towards its actuating position to compress the air, and said ring (21*a*) being adapted to be deformed to allow a renewal of air (25) in the pump cylinder (22) when the actuating member (30) is brought back towards its resting position.

2. Device according to claim 1 in which said plunger (21) of the second pump (20) is secured to the collar (15) and slides in the pump cylinder (22) formed in the actuating member (30), said pump cylinder (22) being connected to said outlet (31) by an air duct (32).

3. Device according to claim 2 in which said air duct (32) includes a valve (33) adapted to be opened when the compressed air in the pump cylinder (22) is compressed to a predetermined level.

4. Device according claim 1, 2, or 3 including in addition an expulsion chamber (35) connected to the first pump (10), to the second pump (20) and to the outlet (31), the product and the compressed air being mixed in said expulsion chamber (35) before being sprayed through the outlet (31).

5. Device according to claim 1, 2, or 3 in which the volume of the pump cylinder (22) is approximately zero when the actuating member (30) is in its actuating position.

6. Device according to claim 1, 2, or 3 in which said collar (15) includes ratcheting means (16) for ratcheting to said attachment member (11) of the first pump (10).

7. Device according to claim 4 in which the volume of the pump cylinder is approximately zero when the actuating member is in its actuating position.

8. Device according to claim 7 in which said collar includes ratcheting means for ratcheting to said attachment member of the first pump.

9. Device according to claim 6 in which the volume of the pump cylinder is approximately zero when the actuating member is in its actuating position.

10. Device according to claim 4 in which said collar includes ratcheting means for ratcheting to said attachment member of the first pump.

11. Device according to claim 5 in which said collar includes ratcheting means for ratcheting to said attachment member of the first pump.

* * * * *